US005218980A

United States Patent [19]

Evans

[11] Patent Number: 5,218,980

[45] Date of Patent: Jun. 15, 1993

[54] ULTRASONIC DISHWASHER SYSTEM

[76] Inventor: David H. Evans, 3600 Harbor Blvd., Ste. 117, Channel Island Harbor, Calif. 93035

[21] Appl. No.: 774,476

[22] Filed: Oct. 10, 1991

[51] Int. Cl.[5] ..... A47L 15/24; A47L 15/42

[52] U.S. Cl. ..... 134/68; 134/1; 134/74; 134/111; 134/184; 310/317

[58] Field of Search ..... 134/1, 68, 73, 74, 111, 134/133, 134, 184; 68/3 SS; 366/127; 310/317

[56] References Cited

U.S. PATENT DOCUMENTS

| | | | |
|---|---|---|---|
| 2,985,003 | 5/1961 | Gelfand et al. | 134/1 X |
| 3,371,233 | 2/1968 | Cook | 134/184 X |
| 3,963,984 | 6/1976 | Coulter | 134/1 X |
| 4,170,241 | 10/1979 | Clapp | 134/184 X |
| 4,498,934 | 2/1985 | Potts | 134/74 X |
| 5,076,854 | 12/1991 | Honda et al. | 134/184 X |

FOREIGN PATENT DOCUMENTS

| | | | |
|---|---|---|---|
| 790671 | 2/1958 | United Kingdom | 134/1 |
| 838581 | 6/1960 | United Kingdom | 134/1 |

*Primary Examiner*—Philip R. Coe

*Attorney, Agent, or Firm*—Kelly Bauersfeld & Lowry

[57] ABSTRACT

An improved dishwasher system utilizes ultrasonic signals to clean a wide range of kitchen and/or dining ware items. The system includes one or more ultrasonic signal generators submerged within a water bath and regulated by a controller to generate an ultrasonic signal, resulting in the production of a large quantity of cavitation bubbles which implode with a vigorous cleaning action against submerged kitchen ware items. The controller rapidly varies the specific frequency of the generated ultrasonic signal, preferably in conjunction with a rapid on-off pulse cycling of the signal, to prevent damage to or breakage of fragile ware items.

16 Claims, 3 Drawing Sheets

FIG. 1
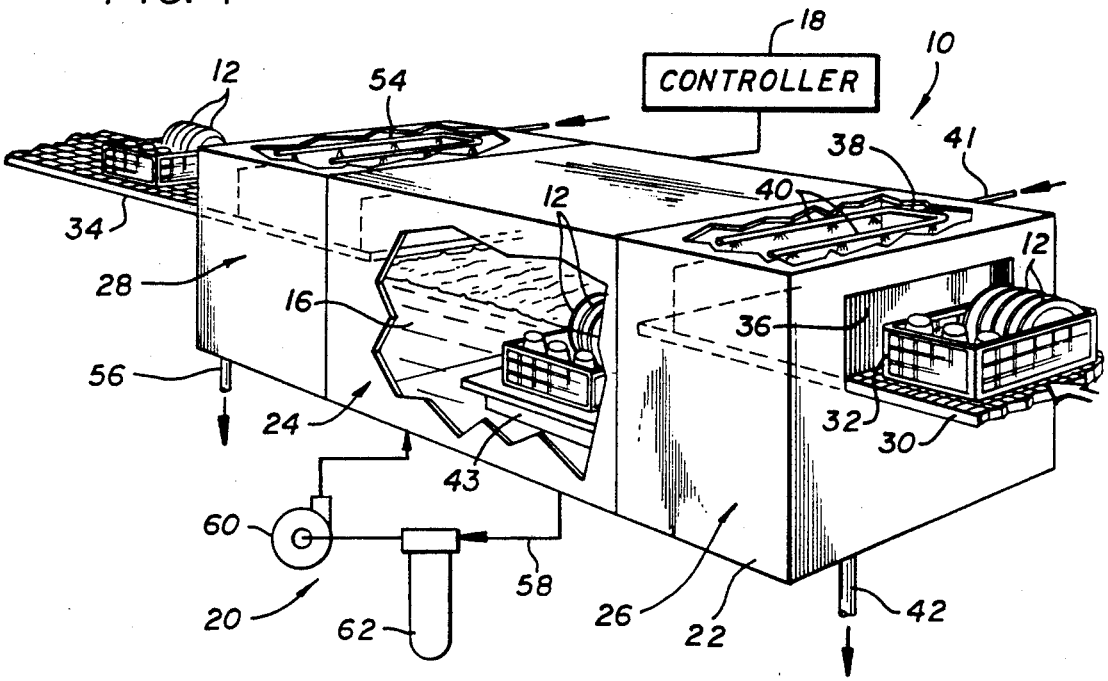
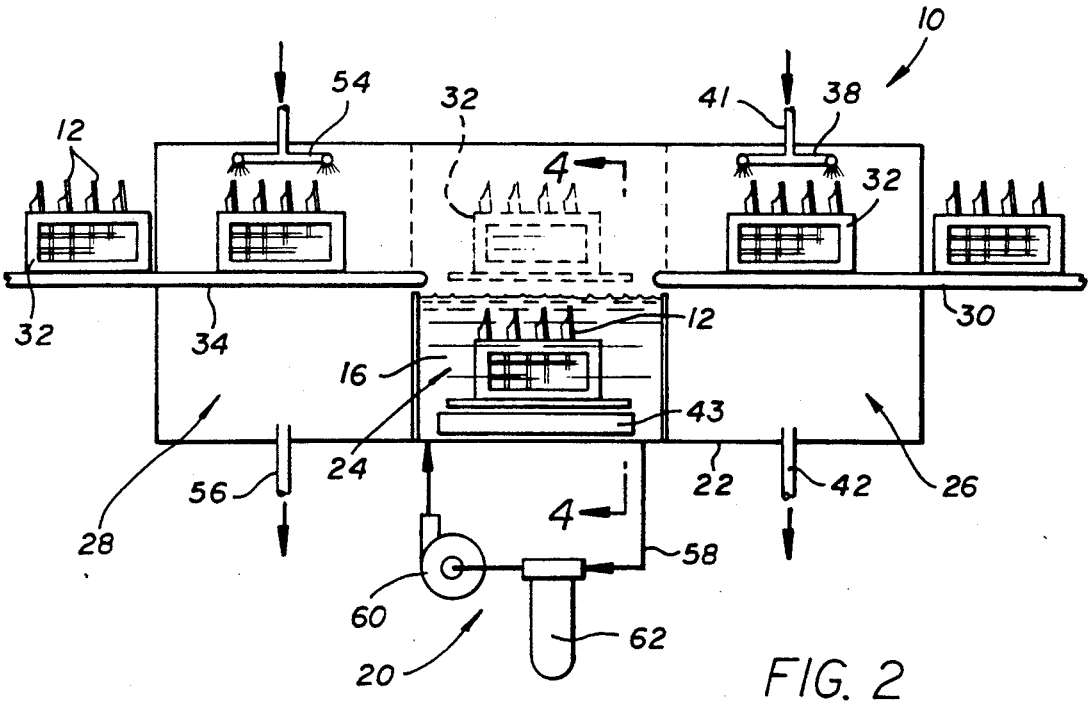
FIG. 2

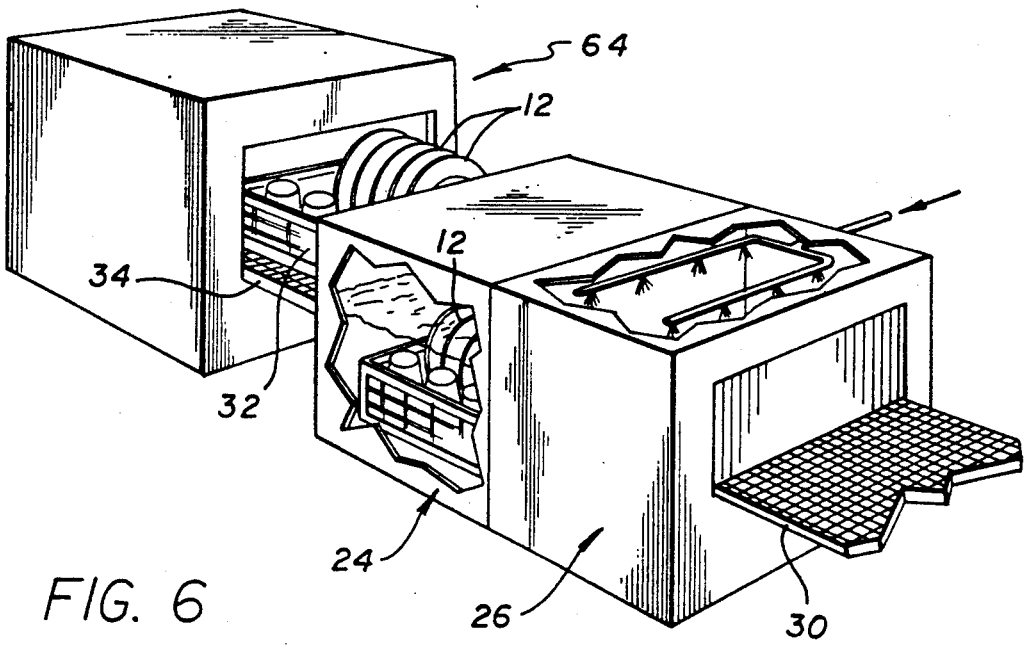
FIG. 6
FIG. 5
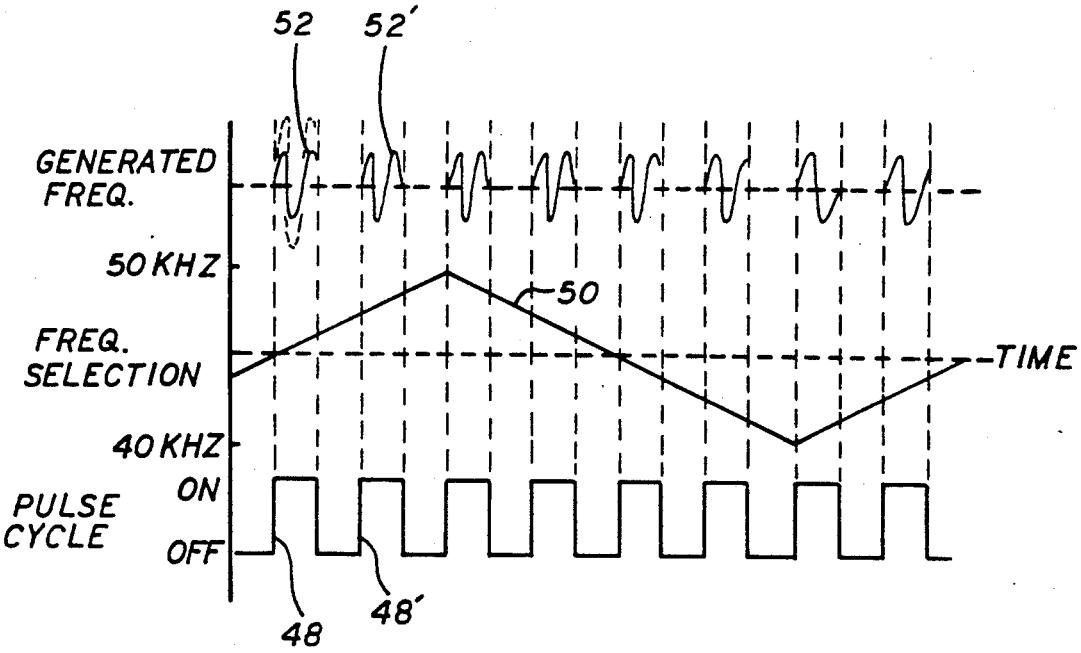

ULTRASONIC DISHWASHER SYSTEM

BACKGROUND OF THE INVENTION

This invention relates generally to dishwasher apparatus and methods for use in cleaning kitchen and dining ware. More particularly, this invention relates to an improved dishwasher system which utilizes ultrasound for effectively and thoroughly cleaning kitchen and dining ware items, in a manner which minimizes the use of water and chemical detergents, and further in a manner substantially eliminating damage to or breakage of fragile items.

Dishwasher systems and methods are well-known in the art for cleaning food debris from kitchen and dining ware items. In particular, known dishwasher systems have commonly relied upon chemical detergents or similar cleaning agents used in combination with heated and/or jetted water to remove food debris from pots and pans, eating and serving utensils, dishware, and cups and glasses, etc. These same principles have been applied uniformly in commercial and institutional eating establishments as well as in a residential environment. In all cases, relatively large quantities of water are required in the course of cleaning and rinsing soiled ware items. In addition, significant quantities of chemical detergents and the like are used. The expended water and chemical detergents, together with food debris removed from the kitchen ware items, are normally discharged to a drain for passage to the local sewage or septic system.

Traditional dishwasher systems and methods of this general type present a variety of limitations and disadvantages which are particularly apparent in commercial or institutional kitchens wherein large quantities of different ware items must be washed on a frequent or near-continuous basis. In such facilities, manual dishwasher techniques involving manual handling and scrubbing of each ware item in a hot water detergent bath are generally being replaced in favor of dishwasher appliances designed to speed the washing process while reducing manual labor requirements and labor costs associated therewith. However, it is widely recognized that many types of food debris such as dried-on or baked-on material are extremely difficult or impossible to remove without individual manual scrubbing of the ware item. Accordingly, while automated dishwasher appliances have provided significant improvements in faster washing with lower labor costs, most commercial and institutional kitchens utilize a pre-rinse station whereat soiled kitchen ware items are manually inspected one at a time, and if appropriate, heavy or stubborn debris is removed with a combination of jetted hot water, detergent, and/or manual scrubbing. As a result, substantial manual labor and related labor costs are still required. Moreover, the requirement for hot water at pre-rinse and wash stations results in high system energy usage. Still further, this requisite manual handling of the individual ware items in a generally wet and slippery environment increases the risk of breakage to fragile glass ware and the like, as well as risk of employee injury upon exposure to broken glass items and/or to the generally wet and slippery work environment.

In addition, increased attention has focused in recent years upon the relatively high usage rate of water and detergent in commercial dishwashing systems inclusive of pre-rinse stations. That is, such dishwashing systems can require several hundred thousand gallons of water each year in a single restaurant establishment, together, with a corresponding usage of several thousand gallons of detergent. This high water use can be extremely undesirable in geographical areas having a limited water supply due to drought or general arid conditions. Moreover, the resultant high rate of discharge of water and chemicals to the local sewage or septic system, particularly in conjunction with large quantities of removed food material, can be extremely undesirable.

Alternative cleaning methods utilizing ultrasound principles are known in the art wherein one or more ultrasonic signal generators provide cavitation bubbles within a water bath for vigorously scrubbing a substrate to be cleaned. More specifically, the ultrasonic generator radiates a high frequency sound wave through the water bath, with the rapidly alternating wave producing a sequence of localized positive and negative pressure regions. The negative pressure regions effectively separate or cavitate the water bath to produce a large quantity of minute bubbles. As these cavitation bubbles within the water bath are contacted against a surface to be cleaned, the bubbles implode and thus provide a substantial mechanical scrubbing action which can be effective in dislodging and removing debris from a submerged target substrate.

Although ultrasonic cleaning systems are applicable in theory for use in cleaning many different types of substrates, including kitchen ware items, attempts to apply ultrasound principles to clean kitchen and dining ware items has not met with success. Instead, breakable kitchen ware items of glass, ceramic and/or similar materials have been highly susceptible to breakage when subjected to ultrasonic cleaning action for even short periods of time. It is believed that the high incidence of kitchen ware breakage in ultrasonic cleaning systems has been attributable to a combination of the highly vigorous bubble scrubbing action and the presence of standing or resonant waves within the water bath.

The present invention overcomes the problems and disadvantages of the prior art by providing an improved ultrasonic dishwasher system designed for effectively and quickly cleaning food debris from a wide and virtually unrestricted range of kitchen and dining ware items, wherein the ultrasonic cleaning action is applied in a regulated manner which substantially reduces or eliminates risk of fragile product breakage. In addition, the ultrasonic cleaning system of the present invention provides effective cleaning of kitchen ware items while substantially reducing requirements for water usage and/or chemical detergents.

SUMMARY OF THE INVENTION

In accordance with the invention, an ultrasonic dishwasher system and related method are provided for use in cleaning kitchen and dining ware items. The system includes a water bath in combination with one or more submerged ultrasonic signal generators for producing cavitation bubbles to mechanically scrub and clean food debris from submerged kitchen ware items. A controller regulates the signal generators by rapidly varying the frequency of the ultrasonic signal to substantially minimize or eliminate breakage of relatively fragile kitchen ware items. In the preferred form, the controller additionally regulates the signal generators by rapidly pulsing the generators on and off.

The ultrasonic dishwasher system includes the submerged signal generators positioned, for example, at the opposite sides and at the bottom of a tank containing the water bath. A tray or basket of kitchen ware items to be cleaned is immersed within the water bath, wherein the water bath is desirably heated and may include a minor proportion of a selected cleaning agent. The controller operates the signal generators to produce an ultrasonic signal of rapidly varying frequency, preferably in conjunction with a rapid on-off pulse cycling. As a result, the signal generators produce large quantities of cavitation bubbles which implode against and thereby scrub the ware items. The combination of varying signal frequency and on-off pulse cycling provides a gentle cleaning action for both fragile and nonfragile kitchen ware items, substantially without significant reduction in cleaning efficiency.

In one embodiment, an ultrasonic cleaning station as described above can be integrated into a dishwasher system having a post-wash sanitizing rinse station and, if desired, a pre-wash rinse station. Alternately, the ultrasonic cleaning station can be used as a pre-wash station in advance of a conventional dishwasher appliance. In either case, appropriate conveyor means may be provided to load and unload ware items with respect to each process station. The water bath at the ultrasonic cleaning station can be circulated intermittently or continuously through a filter circuit to remove entrained debris and recycle the filtered water to the cleaning station.

Other features and advantages of the present invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 1 is a diagrammatic perspective view illustrating an ultrasonic dishwasher system embodying the novel features of the invention;

FIG. 2 is an enlarged and somewhat diagrammatic side elevation view of the dishwasher system of FIG. 1;

FIG. 5 is a graphic representation of ultrasonic signals and generation thereof in accordance with the invention; and FIG. 6 is an enlarged fragmented perspective view illustrating an alternative preferred form of the invention.

DETAILED DESCRIPTION OF THE PREFERRED EMBODIMENTS

Figure 3:
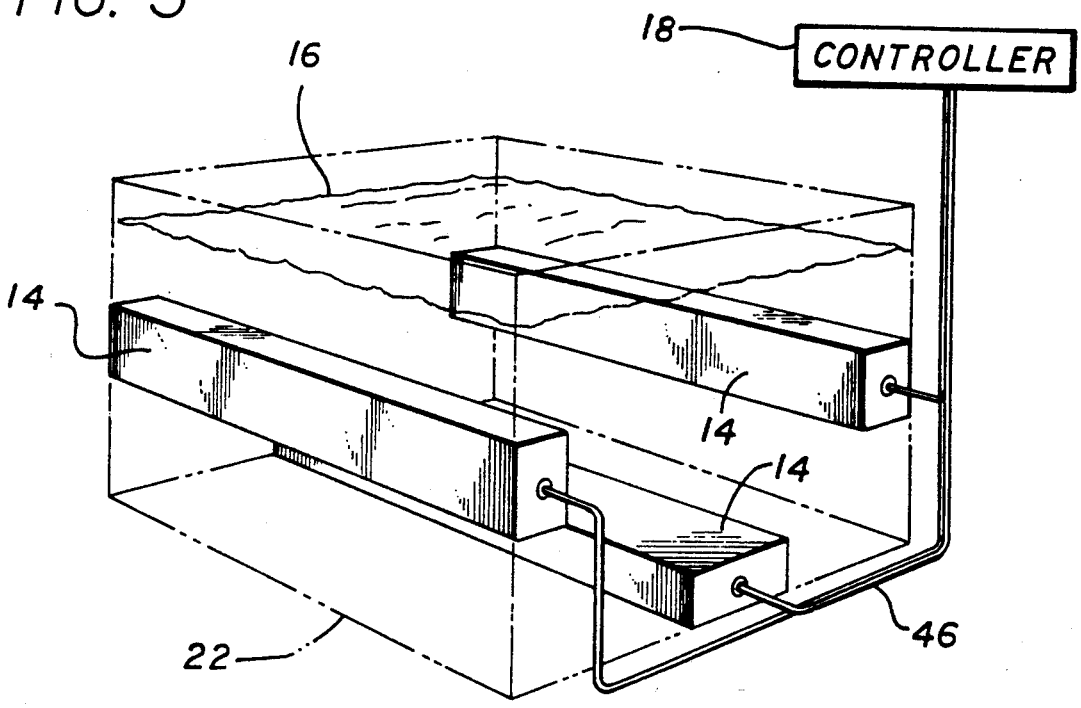
FIG. 3 is an enlarged perspective diagram illustrating an ultrasonic water bath for use in the invention.

As shown in the exemplary drawings, an ultrasonic dishwasher system referred to generally in FIG. 1 by the reference numeral 10 is provided for cleaning kitchen and dining ware items 12, such as pots and pans, eating and serving utensils, dishware, cups and glasses, etc. The dishwasher system 10 includes one or more ultrasonic signal generators 14 (FIGS. 3 and 4) within a water bath 16, wherein operation of the generators 14 is closely regulated by a controller 18 to provide an efficient ultrasonic cleaning action in a manner which substantially reduces or eliminates risk of breakage to fragile ware items.

The ultrasonic dishwasher system 10 of the present invention is particularly designed for rapidly and efficiently cleaning kitchen ware items in a thorough yet safe manner, with little or no risk of breaking fragile items such as glass ware or crystal, ceramic ware, and the like. The system 10 may be adapted for substantially automated flow-through passage of the ware items to be cleaned, with minimal manual handling requirements. In addition, the ultrasonic dishwasher system utilizes a relatively small volume of water which may be circulated through a filter circuit 20 to remove food debris and material therefrom, and then recycled for reuse. As a result, in comparison with conventional dishwasher appliances, overall water usage is significantly reduced.

FIGS. 1 and 2 illustrate the ultrasonic dishwasher system in one preferred form adapted for use in cleaning large quantities of kitchen and dining ware 12 in a commercial or institutional kitchen or the like. In general terms, the system 10 includes a housing 22 subdivided into a main or central ultrasonic cleaning station 24 disposed between a pre-wash rinse station 26 and a post-wash sanitizing rinse station 28. An input conveyor 30 receives kitchen ware items 12 to be cleaned, wherein a group or batch of the ware items may be carried in a suitable tray or basket 32. An output conveyor 34 is also provided to transport a tray or basket of cleaned ware items from the dishwasher system. Although construction details of the input and output conveyors 30 and 34 are not provided herein, it will be understood that these conveyors may take any suitable operational form known to those skilled in the art and adapted to provide automatic conveyance and/or to permit manual push-through travel of the ware baskets through the system.

A basket 32 of soiled kitchen ware items 12 is delivered along the input conveyor 30 through an entrance door 36 to the housing interior at the pre-wash rinse station 26. This rinse station 26 includes a spray manifold 38 disposed in an overhead position relative to the input conveyor 30 and a basket 32 of kitchen ware thereon. A set of downwardly oriented jet nozzles 40 on the spray manifold provide water jets which spray against and provide a rough or gross cleaning action to the soiled ware items 12. The jetted water from the nozzles 40 may be preheated for more efficient pre-cleaning action. This jetted water may be obtained directly from the local water supply via an input conduit 41 and then discharged through a drain 42, as viewed in FIG. 1. Alternately, the water at the rinse station 26 can be filtered and recirculated, if desired.

From the pre-wash rinse station 26, the basket 32 of kitchen ware items 12 is conveyed to the ultrasonic cleaning station 24. Within the cleaning station 24, the basket 32 is initially disposed above the surface of the water bath 16 contained within a tank defined by a portion of the system housing 22. Means are provided for lowering the basket 32 into the water bath 16 to immerse or submerge the batch of ware items 12, with FIGS. 1 and 2 depicting a vertical elevator apparatus 43. This elevator aperture 43 can be designed for automatic timed immersion of a basket 32 within the water bath 16, or for manually activated immersion of the basket, all in a manner known to persons skilled in the art. Alternatively, other types of vertical transport systems such as inclined conveyor segments and the like may be used.

Figure 4:
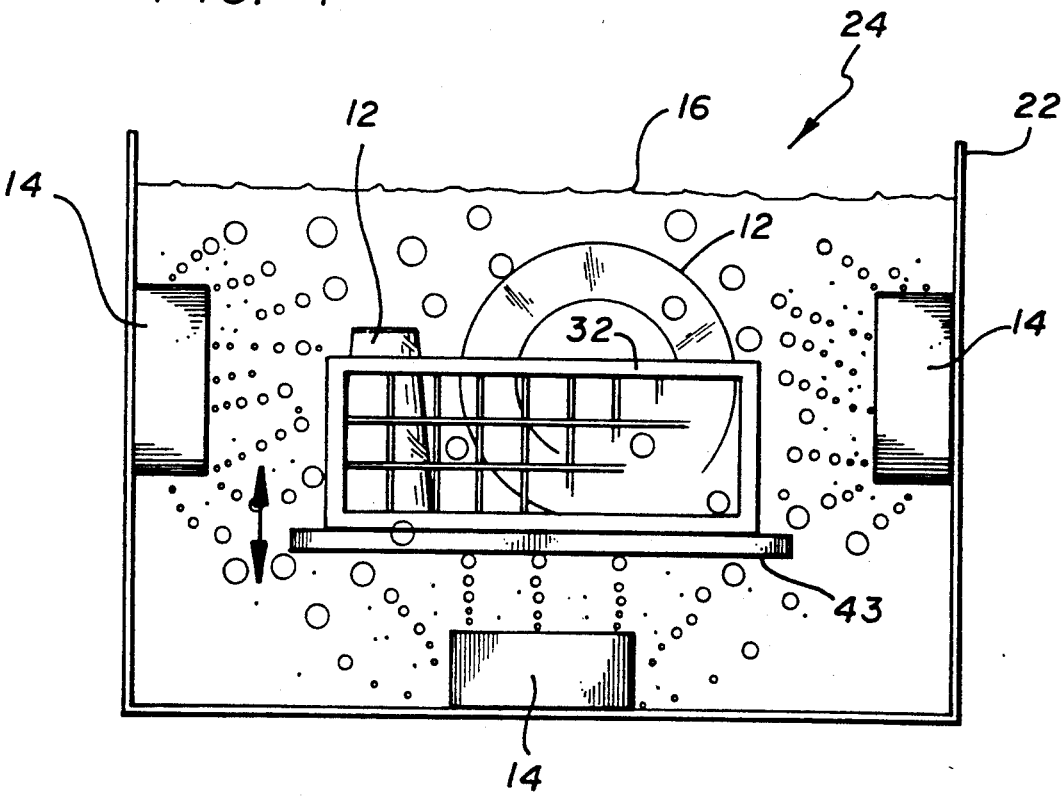
FIG. 4 is a fragmented vertical sectional view taken generally on the line 4—4 of FIG. 2.

At least one ultrasonic signal generator 14 is mounted on the interior walls of the water tank at a position submerged within the water bath 16, with a preferred arrangement being shown in FIG. 3 to include three separate generators 14 mounted respectively along opposite side walls and along the bottom wall of the tank. These ultrasonic signal generators are connected via an appropriate water-sealed conduit 46 to the controller 18 disposed at a convenient position outside the water bath. The controller 18 operates the generators 14, as will be described in more detail, to produce ultrasonic signals for purposes of cleaning the ware items 12.

Each of the ultrasonic signal generators has a construction known in the art to include an ultrasonic transducer element (not shown) mounted onto a resonant plate or similar structure. When energized, the transducer elements oscillate the resonant plate to produce a high pitched and high frequency ultrasonic wave which is radiated to the surrounding environment. In the dishwasher system 10, the transducer elements and resonant plates are contained within sealed casings immersed within the water bath 16, such that the ultrasonic signals are radiated to the water bath 16.

The preferred ultrasonic generators 14 for use in the present invention include piezoelectric transducer elements for generating ultrasonic signals within a variable frequency range on the order of about 30–50 kilohertz. Such signal generators are available from KLN Ultraschall GMBH of Heppenheim, Germany, and from Hilsonic Ltd. of Birkenhead, England. A preferred generator 14 in a typical application would have a design capacity for approximately 800 watt average and on the order of 1500 watt peak power output.

The ultrasonic signal imparted to the water bath 16 creates rapidly fluctuating positive and negative pressure variations at localized zones within the water bath as the ultrasonic signal travels therethrough. The negative pressure causes the liquid to pull apart and thereby create tiny or minute cavitation bubbles. Activation of the signal generators 14 thus produces large quantities of virtually millions of such cavitation bubbles which pass through the water bath and contact the surfaces of the ware items 12 to be cleaned with an implosive action. This implosive action of the cavitation bubbles provides a vigorous and highly effective cleaning action for removing food debris and the like from the surfaces of the ware items. This cleaning action is enhanced in preferred forms of the invention by heating the water bath 16 to a temperature in the range of about 120–150 degrees Fahrenheit, and by incorporating a minor proportion of a cleaning agent in the water bath. A preferred cleaning agent comprises a nonfoaming or low foaming and biodegradable surfactant, such as that marketed by Lever Industrial Ltd. of Merseyside, England, under the name Titan Intraclean SU 161, and added to the water bath to provide an approximate two percent solution.

The cleaning action provided by the ultrasonic signal generators 14 is closely regulated by the controller 18 to prevent damage to or breakage of fragile kitchen ware items. More specifically, and as shown by reference to FIG. 5, the controller 18 variably selects the specific frequency of the ultrasonic signal emanating from the generators 14. In this regard, the frequency of the generated signal is rapidly altered to prevent the occurrence of standing or resonant waves within the water bath. FIG. 5 illustrates rapid alteration of the generated signal in accordance with a sawtooth ramp function between lower and upper frequency limits. Although the specific range of ultrasonic frequencies can vary, as well as the specific frequency variation function, a contemplated signal frequency range is on the order of 30–50 kilohertz, with a preferred signal range on the order of about 38–42 kilohertz. Similarly, the sweep time for cycling through the range of ultrasonic frequencies, as represented by the ramp function 50, occurs rapidly with each cycle within about 0.01–1.00 second.

In addition, in the preferred form of the invention, the controller 18 rapidly pulses the signal generator 14 between on and off states, and at a rapid on-off pulse frequency which will normally differ from the instantaneous frequency of the generated signal. As viewed in FIG. 5 by way of example, at the leading edge of each "on" pulse 48, the controller 18 operates the generators 14 to produce an ultrasonic signal having a specific frequency corresponding with the ramp function 50. The generated ultrasonic signal, represented in FIG. 5 by wave form 52, is of very brief duration on the order of 1–2 cycles before the signal is discontinued at the trailing edge of the "on" pulse 48. At the next "on" pulse 48' in succession, a different ultrasonic signal 52' is generated with a frequency selected according to the ramp function 50. Such on-off pulse cycling of the ultrasonic signal combines with the rapid frequency variation to prevent the occurrence of standing resonant waves within the water bath, which could otherwise result in damage to fragile ware items. Although the specific frequency of the on-off pulses can vary, one preferred frequency provides alternating burst and quiet times of uniform duration of about 0.0001–0.01 record. Further control over the generated ultrasonic signal may be provided with amplitude regulation of the signal output, as shown by reference to the dotted line wave form associated with the signal 52 in FIG. 5.

Subsequent to an ultrasonic cleaning cycle of selected time duration, typically on the order of 30 to 90 seconds, the elevator apparatus 43 returns to the upper position above the surface of the water bath 16 to deliver the basket 32 with cleaned ware items 12 to the output conveyor 34. The basket 32 travels along the output conveyor to the post-wash sanitizing rinse station whereat the items are subjected to a jetted spray from an overhead manifold 54 in the same general manner as described with respect to the pre-wash station 26. This jetted spray at the post-wash station may be clean water or include appropriate agents for ensuring sanitization of the cleaned ware. Water sprayed from the manifold 54 is collected for purpose via a drain conduit 56 to a suitable drain (not shown). The cleaned and rinsed items then pass in the basket 32 through an exit door 54 along the outlet conveyor.

In accordance with further aspects of the invention, the water constituting the water bath 16 can be filtered and recycled to provide substantial savings in water usage. In particular, FIGS. 1 and 2 show the filter circuit 20 to include a recirculated conduit 58 through which the water bath 16 can be drawn by a pump 60 for passage through a filter unit 62 prior to return circulation to the ultrasonic cleaning station 24. The filter unit 62 is designed to remove entrained food material and the like from the water, thereby advantageously permitting such material to be separately collected and disposed while additionally permitting water re-use. The filtration step may proceed continuously during system operation, or intermittently between cleaning sequences as a basket of ware items is submerged within the water bath.

In one alternative preferred form of the invention, as shown in FIG. 6, the ultrasonic cleaning station may be employed as a pre-cleaning station with respect to a conventional dishwasher appliance 64. In this arrangement, the ultrasonic cleaning station 24 may be associated with a pre-rinse station 26 and corresponding input conveyor 30, all operated by a controller as previously described. However, the post-wash sanitizing rinse station is omitted from this modified system. Instead, the cleaned ware items 12 are delivered along an output conveyor 34 directly into the dishwasher appliance 64, which includes conventional jetted water and chemical detergent means for further cleaning the kitchen ware items.

The improved ultrasonic dishwasher system 10 of the present invention thus provides an effective apparatus and method for using ultrasonically generated cavitation bubbles to clean kitchen and dining ware items. The cavitation bubbles are produced by appropriate regulation of ultrasonic signal generators to prevent occurrence of standing or resonant waves within the water bath, and thereby prevent undesired damage to the ware items. In this regard, in the various embodiments of the invention, it is normally disirable to degas the water at the ultrasonic cleaning station before operating the system to clean dishes and the like. Degassing is accomplished by operating the generators within the water bath for a short time period of a few minutes before loading ware items to be cleaned.

A variety of further modifications and improvements to the ultrasonic dishwasher system 10 of the present invention will be apparent to those skilled in the art. For example, the ultrasonic cleaning station 24 can be used as a independent wash station without the associated pre-wash station 26 and/or the post wash station 28. Moreover, the system may take any of a variety of geometric forms, including stations arranged in a circular pattern, etc. Accordingly, no limitation on the invention is intended by way of the foregoing description and accompanying drawings, except as set forth in the appended claims.

What is claimed is:

1. An ultrasonic dishwasher system, comprising:

a water bath for receiving ware items to be cleaned;

at least one ultrasonic signal generator submerged within said water bath; and a controller for operating said signal generator to produce a succession of short burst ultrasonic signals for generating a large quantity of cavitation bubbles within said water bath, said controller including means for rapidly pulsing said signal generator between off and n states of substantially uniform duration, and for generating different specific ultrasonic signal frequencies within a selected frequency range for successive on states.

2. The ultrasonic dishwasher system of claim 1 further including conveyor means for delivering ware items to said water bath for cleaning, and for conveying ware items from said water bath after cleaning.

3. The ultrasonic dishwasher system of claim 1 including an upwardly open tank having said water bath therein, said tank having opposed side and end walls, and a bottom wall, said at least one signal generator comprising three signal generators mounted within said tank at positions respectively along said opposed side walls and said bottom wall.

4. The ultrasonic dishwasher system of claim 1 further including a post-wash rinse station for rinsing ware items cleaned within said water bath.

5. The ultrasonic dishwasher system of claim 1 further including a pre-wash rinse station for rinsing ware items to be cleaned within said water bath.

6. The ultrasonic dishwasher system of claim 1 further including filter means for filtering particulate material from said water bath.

7. The ultrasonic dishwasher system of claim 1 further including means for selectively varying the amplitude of each generated ultrasonic signal.

8. The ultrasonic dishwasher system of claim 1 wherein said specific frequencies of the generated ultrasonic signals include means for generating each ultrasonic signal within a frequency range of from about 30 kilohertz to about 50 kilohertz.

9. The ultrasonic dishwasher system of claim 8 wherein said generating means includes means for rapidly pulsing said signal generator between on and off state to provide alternating burst and quiet times of substantially uniform duration of about 0.0001–0.01 second.

10. An ultrasonic cleaning system, comprising:

an upwardly open tank for receiving a water bath, and for receiving items to be cleaned within the water bath;

at least one ultrasonic signal generator mounted within said tank at a location submerged within the water bath when the water bath is within said tank; and a controller for operating said signal generator to produce a succession of short burst ultrasonic signals for generating a large quantity of cavitation bubbles within said water bath, said controller including means for rapidly pulsing said signal generator between off and on states of substantially uniform duration and for generating different specific ultrasonic signal frequencies within a selected frequency range for successive on states.

11. The ultrasonic cleaning system of claim 10 further including conveyor means for transporting items to be cleaned to and from said tank.

12. The ultrasonic cleaning system of claim 10 wherein said at least one signal generator comprises a plurality of signal generators mounted within said tank of spaced apart locations.

13. The ultrasonic cleaning system of claim 10 further including a post-wash water rinse station for rinsing items cleaned within said tank.

14. The ultrasonic cleaning system of claim 10 further including a pre-wash water rinse obtain for rinsing items to be cleaned within said tank.

15. The ultrasonic cleaning system of claim 10 further including filter means for removing particulate from a water bath within said tank.

16. The ultrasonic cleaning system of claim 10 further including means for selectively varying the amplitude of each generated ultrasonic signal.

* * * * *